United States Patent [19]

Nilssen

[11] Patent Number: 4,972,126

[45] Date of Patent: Nov. 20, 1990

[54] BALLASTING SYSTEM FOR FLUORESCENT LAMPS

[76] Inventor: Ole K. Nilssen, Caesar Dr., Rt. 5, Barrington, Ill. 60010

[21] Appl. No.: 399,400

[22] Filed: Aug. 28, 1989

Related U.S. Application Data

[63] Continuation of Ser. No. 732,551, May 9, 1985, abandoned.

[51] Int. Cl.[5] ..... H05B 41/24; H05B 41/29

[52] U.S. Cl. ..... 315/324; 315/174; 315/209 R; 315/DIG. 5

[58] Field of Search ..... 315/174, 175, 209 R, 315/312, 317, 318, 319, 324, DIG. 5; 363/50, 159, 172

[56] References Cited

U.S. PATENT DOCUMENTS

| | | | |
|---|---|---|---|
| 4,277,726 | 7/1981 | Burke | 315/101 |
| 4,502,107 | 2/1985 | Nilssen | 363/133 |
| 4,508,996 | 4/1985 | Clegg et al. | 315/250 |

*Primary Examiner*—David Mis

[57] ABSTRACT

A ballasting system for powering an array of floures-cent lamp assemblies, as in a sun tanning apparatus, comprises an electronic frequency converter adapted to convert ordinary 60 Hz power line voltage into two non-current-limited high frequency outputs: a first output of 400 Volt/30 kHz sinusoidal voltage provided between a first pair of distribution conductors, and a second output of 50 Volt/30 kHz sinusoidal voltage provided between a second pair of distribution conductors. Each lamp assembly comprises two mutually parallel-disposed series-connected fluorescent lamps. The 50 Volt/30 kHz voltage is provided to the one end of this assembly and is used by way of an isolation transformer means to provide cathode heating power for the two lamp cathodes located near that end. The 400 Volt/30 kHz, voltage is provided to the other end of the assembly and, in addition to providing cathode heating power by way of isolation transformer means, provides a voltage of magnitude directly suitable for starting and running the two series-connected lamps by way of a simple inductive or capacitive reactance ballast. Every other lamp assembly is ballasted with an inductive reactance ballast; and every alternate other lamp assembly is ballasted with a capacitive reactance ballast. That way, the net load represented by any even number of lamp assemblies will be substantially resistive.

9 Claims, 2 Drawing Sheets

BALLASTING SYSTEM FOR FLUORESCENT LAMPS

This application is a continuation of Ser. No. 732,551, filed May 9, 1985, abandoned.

BACKGROUND OF THE INVENTION

1. Field of Invention

The present invention relates to ballasting systems particularly useful in applications involving the use of a plurality of fluorescent lamps in a relatively small space.

2. Prior Art

An ordinary sun tanning bed or a common advertising sign may typically comprise between 20 and 40 mutually parallel-disposed fluorescent lamps. In a sun tanning bed, these lamps are each typically 72" long and requires about 100 Watt of power input for effective operation. The lamps in these sun tanning beds or signs are powered by way of a plurality of individual ballasts, with each ballast powering one or two lamps.

The fluorescent lamps used are most often of the so-called rapid-start high-output type; which implies that each lamp requires four supply wires for proper operation. As an overall result, the number of wires required for powering 20-to-40 fluorescent lamps gets to be very unwieldy.

SUMMARY OF THE INVENTION

Brief Description

In its preferred embodiment, subject invention constitutes a ballasting system for an array of fluorescent lamp assemblies and comprises an electronic frequency converter adapted to convert ordinary 60 Hz power line voltage into two non-current-limited high frequency outputs: a first output of 400 Volt/30 kHz sinusoidal voltage provided between a first pair of distribution conductors, and a second output of 50 Volt/30 kHz sinusoidal voltage provided between a second pair of distribution conductors.

Each lamp assembly comprises two mutually parallel-disposed series-connected fluorescent lamps and has a first and a second end. The 50 Volt/30 kHz voltage is provided by way of the second pair of distribution conductors to the second end of each lamp assembly and is used by way of an isolation transformer to provide cathode heating power for the two lamp cathodes located nearest thereto. The 400 Volt/30 kHz voltage is provided by way of the first pair of distribution conductors to the first end of each lamp assembly and, in addition to providing for cathode heating power by way of an isolation transformer, provides a voltage of magnitude directly suitable for starting and operating the two series-connected fluorescent lamps by way of a simple inductive or capacitive reactance ballast.

Every other lamp assembly is ballasted with an inductive reactance ballast; and every other alternate other lamp assembly is ballasted with a capacitive reactance ballast. That way, the net overall load presented by any even number of lamp assemblies will be substantially resistive.

DESCRIPTION OF THE PREFERRED EMBODIMENT

Details of Construction

Figure 1:
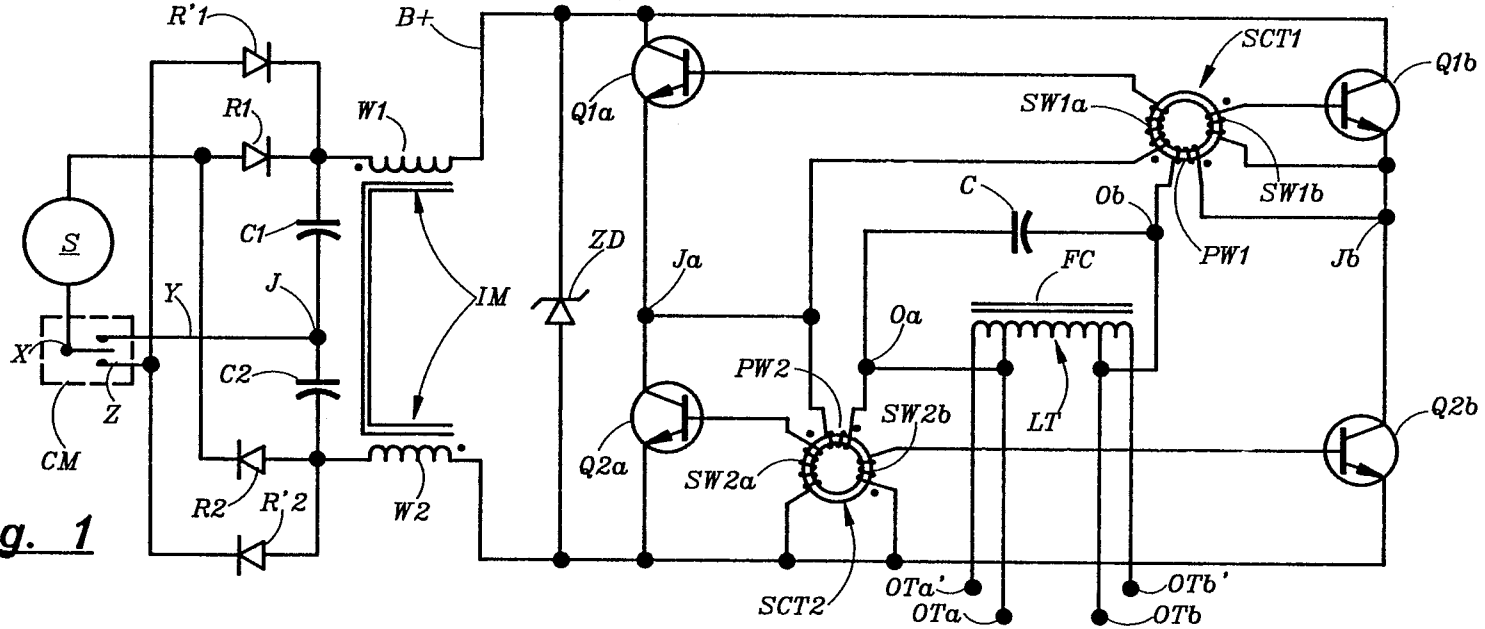
FIG. 1 provides a schematic illustration of the frequency converter means used in the preferred embodiment of the invention.

FIG. 1 shows an AC power supply S, one terminal of which is connected to a point X. This point X is connected by way of a connection means CM to conductor Y, which is connected to a junction J between two energy-storing capacitors C1 and C2.

The other terminal of power supply S is connected to the anode of a rectifier R1 and to the cathode of a rectifier R2. Rectifier R1 has its cathode connected to one terminal of C1 —the other terminal of C1 being connected to junction J. Rectifier R2 has its anode connected to one terminal of C2—the other terminal of C2 being connected to junction J.

Connected with connector means CM is a conductor Z, which is connected to the anode of a rectifier R'1 and to the cathode of a rectifier R'2. Rectifier R'1 has its cathode connected to the cathode of rectifier R1; and rectifier R'2 has its anode connected to the anode of rectifier R2.

An inductor means IM has two equal but separate windings W1 and W2.

Winding W1 is connected between the cathode of rectifier R1 and a bus conductor B+; which bus conductor is connected to the collectors of two transistors Q1*a* and Q1*b*.

Winding W2 is connected between the anode of R2 and a bus conductor B−; which bus conductor is connected to the emitters of two transistors Q2*a* and Q2*b*.

A Zener diode ZD is connected between the B+ bus and the B− bus.

Transistor Q1*a* is connected with its emitter to a junction Ja, as is also the collector of transistor Q2*a*. Transistor Q1*b* is connected with its emitter to a junction Jb, as is also the collector of transistor Q2*b*.

An inductor-transformer combination LT is wound on a ferrite core FC and is connected between inverter output terminals Oa and Ob. Connected in parallel with LT is a capacitor C. Inverter output terminal Oa is connected with overall output terminal OTa; inverter output terminal Ob is connected with overall output terminal OTb.

Inductor-transformer LT has an auxiliary output terminal connected with output terminals OTa' and OTb'.

Primary winding PW1 of saturable current-transformer SCT1 is connected between junction Jb and output terminal Ob. Primary winding PW2 of saturable current-transformer SCT2 is connected between junction Ja and output terminal Oa.

One secondary winding SW1*a* of transformer SCT1 is connected between the base and the emitter of transistor Q1*a;* another secondary winding SW1*b* of transformer SCT1 is connected between the base and the emitter of transistor Q1*b*.

One secondary winding SW2*a* of transformer SCT2 is connected between the base and the emitter of transistor Q2*a;* another secondary winding SW2*b* of transformer SCT2 is connected between the base and the emitter of transistor Q2*b*.

The complete assembly connected with AC power supply S and having two pairs of output terminals, namely a first pair OTa and OTa', and a second pair OTb and OTb', is referred to as frequency-converting power supply FCPS.

Figure 2:
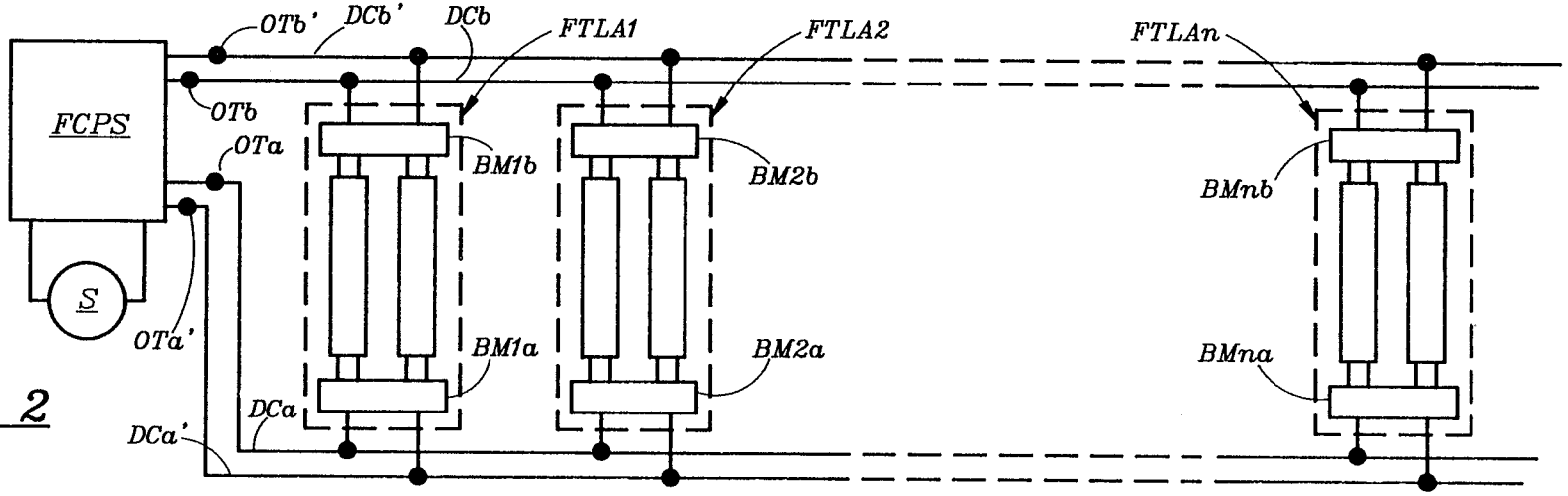
FIG. 2 diagrammatically describes the overall operating system in its preferred embodiment, including the frequency converter means, two pairs of distribution conductors coming therefrom, and plural fluorescent lamp assemblies connected between these pairs of distribution conductors.

FIG. 2 shows the two pairs of output terminals from power supply FCPS connected, by way of distribution conductors DCa, DCa', DCb and DCb', with an array of n fluorescent lamp assemblies: FLA1, FLA2—FLAn. Each fluorescent tanning lamp assembly comprises an associated ballast means: BM1*a* and BM1*b*, BM2*a* and BM2*b* —BMna and BMnb.

Figure 3:
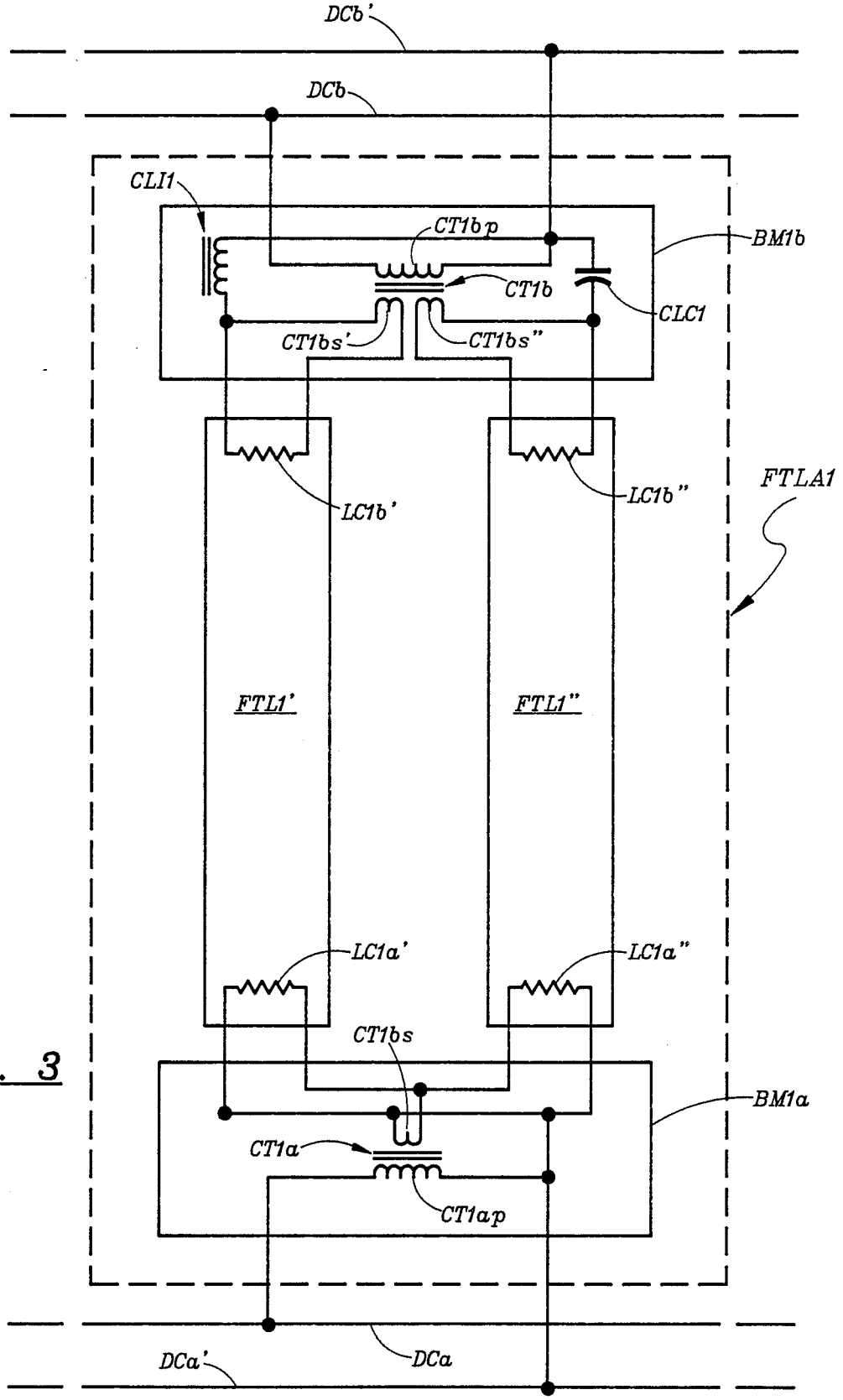
FIG. 3 provides schematic details of a fluorescent lamp assembly.

FIG. 3 shows details of fluorescent lamp assembly FLA1.

A cathode transformer CT1b has a primary winding CT1bp connected across distribution conductors DCb and DCb'; and it has two secondary winding CT1bs' and CT1bs" connected with lamp cathodes LC1*b*' and LC1*b*" of fluorescent lamps FL1' and FL1", respectively.

A current-limiting inductor CLI1 is connected between distribution conductor DCb and one of the terminals of lamp cathode LC1*b*'. One of the terminals of lamp cathode LC1*b*" is connected directly with distribution conductor DCb'.

A cathode transformer CT1a has a primary winding CT1ap connected across distribution conductors DCa and DCa'; and it has a single secondary winding CT1bs connected with parallelconnected lamp cathodes LC1*a*' and LC1*a*" of fluorescent lamps FL" and FL1", respectively. One of the terminals of each of the parallel-connected cathodes is connected with distribution connector DCa' by way of a starting aid capacitor SAC1.

Description of Operation

The operation of the frequency-converting power supply of FIG. 1 may be explained as follows.

AC power supply S provides 120 Volt/60 Hz voltage to the voltage-doubling and rectifying/filtering circuit consisting of R1, R2, C1 and C2. A substantially constant DC voltage of about 320 Volt magnitude then results at the output of this circuit, with the positive side of this DC voltage being provided by way of W1 to the B+ bus, and the negative side being provided by way of W2 to the B− bus.

(If this 120 Volt/60 Hz voltage were to be a 240 Volt/60 Hz voltage instead, the same 320 Volt constant-magnitude DC voltage would result, provided connector means CM is changed so as to have point X make contact with conductor Z instead of with conductor Y. Thus, the frequency-converting power supply FCPS of FIG. 1 may equally well be powered from 120 Volt/60 Hz as from 240 Volt/60 Hz—with essentially the same overall operating results.)

This 320 Volt substantially constant-magnitude DC voltage is applied by way of inductor means IM and its two windings W1 and W2, poled as indicated, to the B+ bus and the B− bus, and thereby to the DC power input terminals of the full-bridge inverter circuit comprising transistors Q1*a*, Q1*b*, Q2*a* and Q2*b*.

This inverter circuit is made to self-oscillate by way of positive current feedback provided by saturable currenttransformers SCT1 and SCT2, poled as indicated. Thus, the magnitude of the current provided to any given transistor's base-emitter junction is proportional to the magnitude of the current flowing between output terminals Oa and Ob.

The frequency of inverter oscillation is determined by a combination of the saturation characteristics of the saturable current-transformers and the natural resonance frequency of the parallel combination of LT and C.

The saturation characteristics of the saturable currenttransformers are substantially identical to one another and so chosen that, when the load connected across output terminals OTa, OTa', OTb and OTb' has no significant reactive component, the waveform of the output voltage provided between any two of the four output terminals is essentially sinusoidal in waveshape.

With the particular circuit components and values chosen, the frequency of this substantially sinusoidal output voltage is approximately 30 kHz.

In combination, the two separate but equal windings W1 and W2 of inductor means IM provide for a total inductance that is large enough so that the current flowing through the two windings and into the inverter remains substantially constant during a complete time-period of one cycle of the inverter's oscillation. Thus, by way of the inverter's commutating action, the inverter's tuned tank circuit (that is, the parallel-combination of LT and C) represents a parallel-resonant circuit that is fed from a substantially constant-magnitude squarewave AC current source.

Of course, over a period of several cycles of the inverter's oscillation, the magnitude of this constant-magnitude squarewave AC current may change—depending on load conditions.

With a DC voltage of about 320 Volt applied to the inverter, the magnitude of the 30 kHz output voltage provided from the inverter, which output voltage is provided between output terminals OTa and OTb, is approximately 350 Volt RMS. The magnitude of the 30 kHz voltage between output terminals OTa and OTa' is approximately 50 Volt RMS. Thus, the magnitude of the 30 kHz voltage provided between output terminals OTb and OTb' is about 400 Volt RMS.

The operation of the overall ballasting system may best be understood by considering FIG. 2 in conjunction with FIG. 3. The several fluorescent lamp assemblies are connected between the two pairs of distribution conductors, namely DCa & DCa' and DCb & DCb', and powered by the 400 Volt/30 kHz substantially sinusoidal constant-magnitude voltage provided between distribution conductors DCb and DCb'. Each of the lamps in these lamp assemblies is a 72" T-12 rapid-start high-output fluorescent lamp. A series-combination of two of these lamps requires an operating voltage of about 250 Volt RMS and, when using a conventional ground plane and starting aid capacitor (such as SAC1), a starting voltage of about 400 Volt RMS. To provide full light output, each lamp requires a lamp current of about 800–1000 milli-Ampere.

The 50 Volt 30 kHz voltage provided between distribution conductors DCa and DCa' is used for providing low voltage heating power for lamp cathodes LC1*a*' and LC1*a*" (the cathodes on the "A" side, or the "A" cathodes) by way of voltage step-down transformer CT1*a*. The fact that distribution conductor DCa' is at the same potential as distribution conductor DCb' permits a starting aid capacitor (SAC1) to be effectively used by placing it between the "A" cathodes and distribution conductor DCa'. Of course, cathode heating power for the "A" cathodes, as well as starting aid voltage, could have been obtained from the voltage between distribution conductors DCb and DCb'. However, this would have entailed a great deal of extra wiring in that a pair of wires would have to go from the DCb/DCb' conductors to the "A" cathodes for each pair of lamps.

With particular reference to FIG. 3, it is seen that the two series-connected fluorescent lamps are connected between the DCb and the DCb' distribution conductors by way of a simple inductive reactor ballast. However, since the AC voltage provided by the DCb/DCb' distribution conductors is of relatively high frequency and substantially of sinusoidal waveshape, the simple inductive reactor ballast could just as well have been a simple capacitive reactor ballast.

In fact, to maximize the power factor by which the combination of the many lamp assemblies draws power from the central frequency-converting power supply (FCPS in FIG. 2), each other lamp assembly uses an inductive reactor ballast for limiting lamp current, and each alternate other lamp assembly uses a capacitive reactor ballast for limiting lamp current. That way, the inductive current component associated with a given lamp assembly (due to the inductive nature of the ballasting means of that assembly) will be cancelled by the capacitive current component associated with the adjacent lamp assembly. Thus, the overall load presented to the frequency-converting power supply by a plurality of lamp assemblies will be substantially resistive.

With the load presented to the central power supply (FCPS) being substantially resistive, the line losses associated with distributing power to the plurality of fluorescent lamp assemblies are minimized, as is also the associated electromagnetic radiation. Moreover, the requirements in respect to the energy-storing capabilities of the inductor LT and/or tank capacitor C of the inverter output circuit has been greatly reduced, as has also inverter frequency variations resulting from loading effects.

Comments (a) The magnitude of the Zener voltage of Zener diode ZD is chosen such as to be somewhat higher than the maximum magnitude of the peak voltage of the sinusoidal half-waves of voltage present across the inverter's output terminals Oa and Ob. That way, the Zener diode will not interfere with normal operation of the inverter; yet, it will prevent the magnitude of the peak voltages of the sinusoidal half-waves from substantially exceeding the normally occurring maximum magnitudes. Without the Zener diode, for various transient reasons (such as due to the sudden removal of a load) the magnitude of the peak voltages of the sinusoidal half-waves would occasionally become substantially larger than the normally occurring maximum magnitudes; and that would either cause transistor destruction, or it would necessitate the use of very special transistors of exceptionally high voltage capabilities.

(b) The inverter of FIG. 1 must be triggered into oscillation. This triggering may be accomplished by way of providing a special trigger winding on each of the feedback current-transformers, and then to discharge a capacitor through these trigger windings. This may be done automatically with an arrangement consisting of a capacitor-resistor combination connected between B+ and B−, and a Diac for discharging the capacitor through the trigger windings. More details in respect to triggering a bridge inverter into oscillation can be found in U.S. Pat. No. 4,502,107 to Nilssen.

(c) There is no basic need for using saturable current transformers in the feedback circuit in the self-oscillating inverter of FIG. 1. Rather, positive feedback can be achieved by way of using one or more secondary windings on the main tank inductor LT. More details in respect to providing feedback in this fashion can be found in U.S. Pat. No. 4,277,726 to Burke.

(d) There is a significant advantage in using a full bridge inverter, as in FIG. 1 hereof, as compared with regular push-pull inverters, as more commonly used in connection with parallel-resonant inverter output circuits. This significant advantage relates to the required voltage-handling capabilities of the inverter transistors. In a bridge inverter, these voltage-handling capabilities need only be half as high as with ordinary push-pull inverters. Thus, if an ordinary current-fed push-pull inverter loaded with a parallel-tuned resonant circuit were to be powered from a 320 Volt DC source, the individual transistors would be exposed to peak voltages as high as 1060 Volt or so; whereas with the bridge inverter of FIG. 1, the transistors would be exposed to peak voltages no higher than about 530 Volt.

(e) Inductor/transformer LT is wound on a ferrite core with a small air gap. Thus, any windings wound on top of or next to the main winding between Oa and Ob will couple tightly therewith.

(f) Inductor means IM may consist of two entirely independent inductors—with one inductor located in each leg of the power supply; or, it is even acceptable in many circumstances that inductor IM be but a single inductor in just one leg of the power supply.

(g) It is noted that the average absolute magnitude of the AC voltage appearing between inverter output terminals Oa and Ob must be substantially equal to the magnitude of the DC voltage present between the B+ bus and the B− bus.

Or, stated differently, in the circuit of FIG. 1, if the inverter's AC output voltage as provided between terminals Oa and Ob were to be rectified in a full-wave rectifier, the average magnitude of the DC voltage obtained from this full-wave rectifier would have to be substantially equal to the magnitude of the DC voltage existing between the B+ bus and the B− bus.

This relationship would have to exist substantially regardless of the nature of the load connected between the inverter's output terminals.

(h) It is believed that the present invention and its several attendant advantages and features will be understood from the preceeding description. However, without departing from the spirit of the invention, changes may be made in its form and in the construction and interrelationships of its component parts, the form herein presented merely representing the presently preferred embodiment.

I claim:

1. A system for providing photic radiation, said system being adapted to be powered from the line voltage of an ordinary electric utility power line and comprising:

a plurality of fluorescent lamp assemblies, each such assembly having: (i) a fluorescent lamp with a first and a second cathode, (ii) a first input terminal means located adjacent said first cathode, (iii) a second input terminal means located adjacent said second cathode, (iv) first power transfer means connected between said first input terminal means and said first cathode, and operative to permit the transfer of electrical power therebetween, said first power transfer means including first transformer means and current-limiting means, and (v) second power transfer means connected between said second input terminal means and said second cathode, and operative to permit electric power transfer therebetween, said second power transfer means including second transformer means;

power conditioning means connected with said power line and operable to provide a first AC voltage at a first output terminal means and a second AC voltage at a second output terminal means;

first distribution conductor means connected with said first output terminal means and operative to provide said first AC voltage to the first input terminal means of each fluorescent lamp assembly; and second distribution conductor means connected with said second output terminal means and operative to provide said second AC voltage to the second input terminal means of each fluorescent lamp assembly.

2. The system of claim 1 wherein: (i) said fluorescent lamp is an essentially straight tubular entity, (ii) the fluorescent lamp in each lamp assembly is substantially parallel with the fluorescent lamp in any of the other lamp assemblies, and (iii) said first distribution conductor means and said second distribution conductor means are both oriented in a substantially perpendicular manner with respect to said fluorescent lamps, whereby no conductor means are required to run parallel with any of the fluorescent lamps.

3. The system of claim 1 wherein said AC voltages are of essentially sinusoidal waveform and fundamental frequency substantially higher than that of said line voltage.

4. The system of claim 1 wherein each of said fluorescent lamp assemblies comprises two series-connected fluorescent lamps.

5. A system for providing photic radiation, said system being adapted to be powered from the line voltage of an ordinary electric utility power line and comprising:

a plurality of fluorescent lamp assemblies, each such assembly having: (i) a first substantially straight and tubular fluorescent lamp with a first and a second cathode, (ii) a second substantially straight and tubular fluorescent lamp with a first and a second cathode, said second lamp being positioned such as to have its first and second cathode adjacent the first and input terminal means located adjacent said first cathodes, (iv) a second input terminal means located adjacent said second cathodes, (v) first power transfer means connected between said first input terminal means and said first cathodes, and operative to permit the transfer of electrical power therebetween, said first power transfer means including first transformer means and current-limiting means, and (vi) second power transfer means connected between said second input terminal means and said second cathode, and operative to permit electric power transfer therebetween, said second power transfer means including second transformer means;

power conditioning means connected with said power line and operable to provide a first AC voltage at a first output terminal means and a second AC voltage at a second output terminal means;

first distribution conductor means connected with said first output terminal means and operative to provide said first AC voltage to the first input terminal means of each fluorescent lamp assembly; and second distribution conductor means connected with said second output terminal means and operative to provide said second AC voltage to the second input terminal means of each fluorescent lamp assembly.

6. The system of claim 5 wherein, within each lamp assembly, said second cathodes are electrically connected together.

7. The system of claim 6 wherein said second distribution conductor means has an electric conductor and wherein said cathodes are connected with said electric conductor by way of a capacitor means.

8. The system of claim 5 wherein: (i) said power conditioning means comprises frequency conversion means, and (ii) the frequency of said first AC voltage is substantially higher than that of said line voltage.

9. A fluorescent lamp assembly requiring for proper operation to be connected with both a first and a second distribution conductor means, each distribution conductor means including at least two electrical conductors between which there exists a voltage differential, the assembly comprising:

a first substantially straight and tubular fluorescent lamp having a first and a second cathode;

a second substantially straight and tubular fluorescent lamp also having a first and a second cathode, said second lamp being positioned in such manner as to have its first and second cathode adjacent the first and second cathode of said first lamp, respectively;

first input terminal means located adjacent said first cathodes and adapted to connect with said first distribution conductor means;

second input terminal means located adjacent said second cathodes and adapted to connect with said second distribution conductor means;

first power transfer means connected between said first input terminal means and said first cathodes, and operative to permit the transfer of electrical power therebetween, said first power transfer means including first transformer means and current-limiting means; and second power transfer means connected between said second input terminal means and said second cathodes, and operative to permit electric power transfer therebetween, said second power transfer means including second transformer means.

* * * * *